US005943831A

United States Patent [19]

Pangburn

[11] Patent Number: 5,943,831

[45] Date of Patent: Aug. 31, 1999

[54] DEVICE FOR HAULING OBJECTS

[76] Inventor: William H. Pangburn, 1257 S. Heron Dr. East, New Palestine, Ind. 46163

[21] Appl. No.: 09/022,202

[22] Filed: Feb. 11, 1998

[51] Int. Cl.[6] ..... B65F 5/00

[52] U.S. Cl. ..... 52/155; 16/DIG. 12

[58] Field of Search ..... 16/110 R, 114 R, 16/125, 127, DIG. 3, DIG. 12, DIG. 24; 52/3, 4, 155

[56] References Cited

U.S. PATENT DOCUMENTS 3,936,088 2/1976 Williams .
4,682,447 7/1987 Osborn .
5,104,133 4/1992 Reiner .
5,564,232 10/1996 Callaway .
5,580,635 12/1996 Hoheisel .
5,660,402 8/1997 Jones et al. .

*Primary Examiner*—Carl D. Friedman
*Assistant Examiner*—Kevin D. Wilkens
*Attorney, Agent, or Firm*—Woodard, Emhardt, Naughton, Moriarty & McNett

[57] ABSTRACT

A handle for pulling or lifting a sheet with leaves thereatop. A handle has a rod shaped main body. The handle is extendable through holes in the sheet. In one design of the handle, a spring biased latch closes adjacent portions of the handle to prevent accidental disengagement of the handle from the sheet. Another handle design has an elastically deformable main body to releasably hold the sheet.

9 Claims, 4 Drawing Sheets

DEVICE FOR HAULING OBJECTS

BACKGROUND OF THE INVENTION

1. Field of the Invention

This invention is in the field of tarpaulins and sheets and associated connectors for moving or hauling objects.

2. Description of the Prior Art

The collection and moving of leaves presents a major problem to the home owner. Various techniques are utilized such as mulching and then leaving the residue atop the grass. Alternatively, the leaves may be raked and gathered into piles and then moved to another location off the lawn. A typical technique is to rake the leaves onto a tarpaulin or bed sheet with the tarpaulin or sheet then being grasped and tugged or pulled to a remote location. As the leaves become wet or large in quantity, it becomes difficult to hold on to the sheet simply by grasping the corner of the sheet by hand. I have therefore devised a handle which may be releasably extended through the sheet allowing a person to grasp the handle to pull or move the sheet with leaves across the lawn. The handle is also particularly useful in pulling other objects such as old shingles removed from a roof or a variety of other objects. In addition, there is a need to provide a handle for lifting the sheet and for allowing the sheet to be formed as a bag to prevent the objects from falling off one edge.

The prior art includes a number of handles fixedly mounted to or removably mounted to a variety of different objects. Likewise, a variety of tarpaulins have been designed for accomplishing a number of objectives. For example, in the U.S. Pat. No. 5,660,402 there is disclosed a lawn tarp for use in pulling a variety of objects across the surface of the ground by hand or while attached behind a motorized vehicle. The tarp includes a plurality of eyelets of adequate size for insertion of a rope or bungee cord. The mounting or forming of eyelets in a tarpaulin is also disclosed in U.S. Pat. No. 4,682,447. Eyelets may be used to fix a tarpaulin to the ground while leaves are placed thereon such as shown in the U.S. Pat. No. 5,564,232. A tarpaulin can also be used to surround a tree to automatically catch the leaves as the leaves fall off the tree such as shown in the U.S. Pat. No. 5,580,635. A flexible handle for moving a tarpaulin equipped with grommets or eyelets is disclosed in U.S. Pat. No. 3,936,088. Another approach is disclosed in U.S. Pat. No. 5,104,133 wherein a flexible generally rectangular sheet shaped as a scoop is used to haul leaves and other materials.

Despite the prior devices and methods, there is still a need for a handle attachable to any type of tarpaulin or sheet which will not accidentally become disengaged from the sheet while at the same time providing a handle for the user to pull and/or lift the sheet. Disclosed herein is such a handle.

SUMMARY OF THE INVENTION

One embodiment of the present invention is a device for hauling leaves comprising a sheet upon which leaves may be placed and having four corners with holes located at each corner. A handle is separable from the sheet but extendable through the holes and releasably engageable with the sheet. The handle may be grasped and pulled to lift and/or move the sheet across the ground thereby conveying the leaves thereon.

It is an object of the present invention to provide a new and improved device for moving leaves, shingles and other objects across ground.

It is a further object of the present invention to provide a combination sheet and handle for hauling objects across a lawn.

In addition, it is an object of the present invention to provide a handle releasably engageable with a sheet for allowing the user to lift the sheet forming a container or bag.

Related object and advantages of the present invention will be apparent from the description herein.

DESCRIPTION OF THE PREFERRED EMBODIMENT

Figure 1:
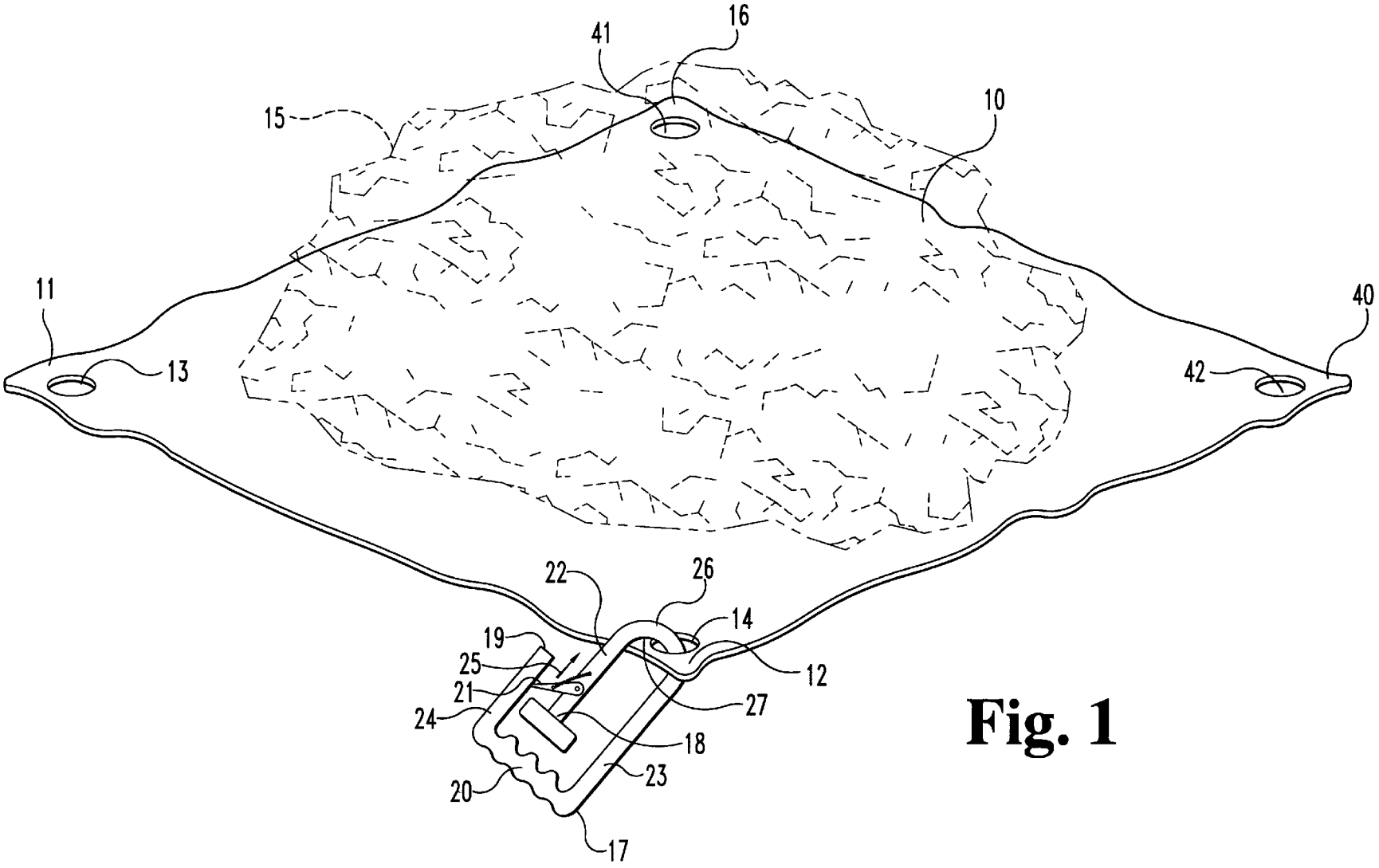
FIG. 1 is a perspective view of a sheet with a handle attached thereto.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a tarpaulin or sheet 10 having four corners 11, 12, 16 and 40 and respectively hole 13, hole 14, hole 41 and hole 42 located at each corner. Resting atop the tarpaulin is a pile 15 of leaves, shingles or other objects. Handle 17 is shown removably attached to the sheet at corner 12.

The preferred embodiment of the invention is shown in FIG. 1. Handle 17 includes a rod shaped main body with a first end 18 and second end 19. The first portion 22 of the rod shaped main body extends from end 18 in a first direction 25 to a first location 26 whereat the rod shaped main body curves forming a second portion 23 extending back in a direction opposite to arrow 25. Second portion 23 extends to a second location 20 whereat the rod shaped main body extends back again in the direction of arrow 25 forming a third portion 24 which extends to end 19. The second portion 23 is thereby positioned between and joined to the first portion 22 and third portion 24 but is separated apart from portions 22 and 24 except at its opposite ends where joined thereto. Likewise, the first portion 22 extends between portions 23 and 24 both of which are located outwardly of first portion 22.

When mounting the handle to the sheet, end 19 is first inserted through hole 14 and the sheet threaded along the length of first portion 24 past location 20 and then along the length of portion 23 until the inwardly facing surface 27 formed by the bend in the rod shaped main body at location 26 contacts and rests against the sheet. The handle may then be pulled at location 20 with the inside diameter of hole 14 thereby contacting stop surface 27 allowing the sheet to be pulled or hauled across ground.

A plurality of ridges are formed in the main body of the handle at location 20 to receive a person's fingers therebetween. The ridges form a grasping portion at location 20 spaced apart from end 18 a sufficient distance to allow a hand to be extended therethrough when grasping the handle.

Figure 6:
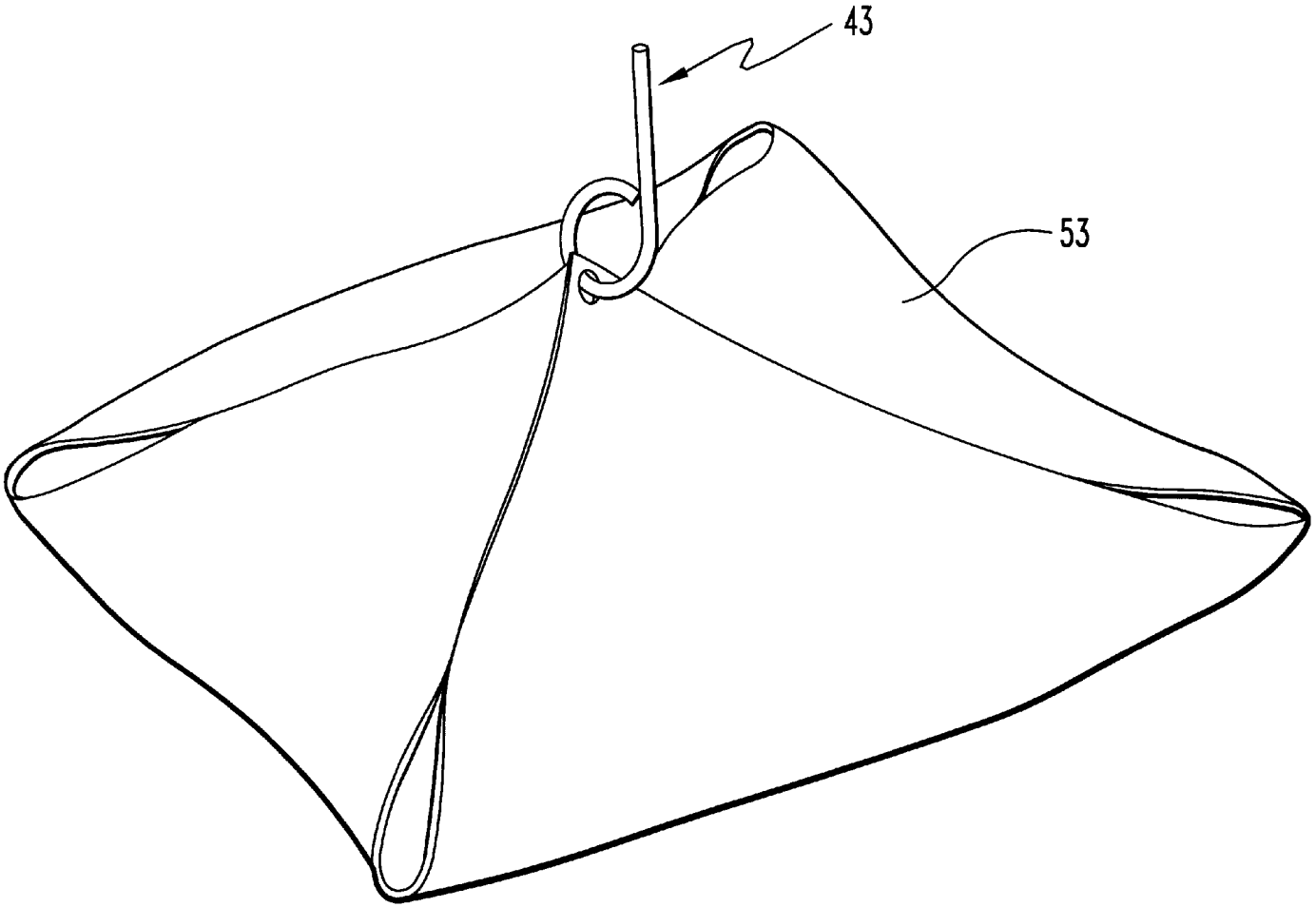
FIG. 6 is a perspective view of the four corners of the sheet attached to the handle forming a bag.

As the handle is pulled in a direction opposite of arrow 25, surface 27 contacts the sheet surrounding the hole 14 enabling the sheet to be pulled across lawn. In the event that each corner has a hole as depicted in FIG. 1, then the handle may be extended through each hole forming a bag or container allowing the sheet to be lifted. For example, end 19 of handle 17 may be extended through holes 14, 13, 41 and 42 and the four corners moved along the length of the handle until the inwardly facing surface 27 of handle 17 contacts the portion of each corner surrounding each hole. A bag 53 (FIG. 6) is thus formed containing the leaves or other objects originally placed atop the sheet. The bag may then lifted onto a vehicle, such as a tractor or simply carried or pulled across the ground to a remote location.

Figure 3:
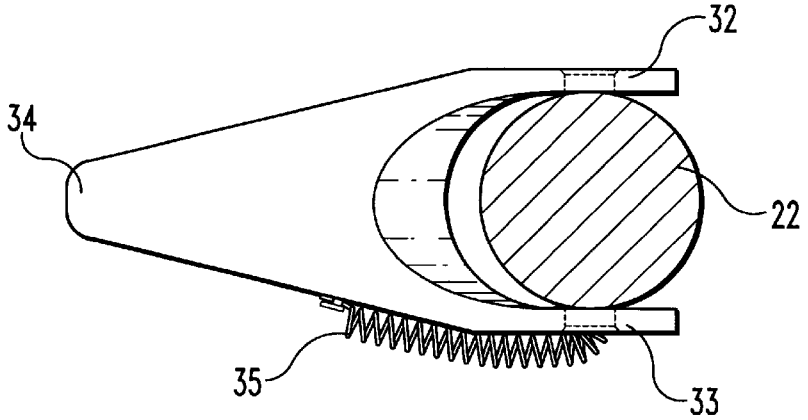
FIG. 3 is a top view of FIG. 2.
Figure 2:
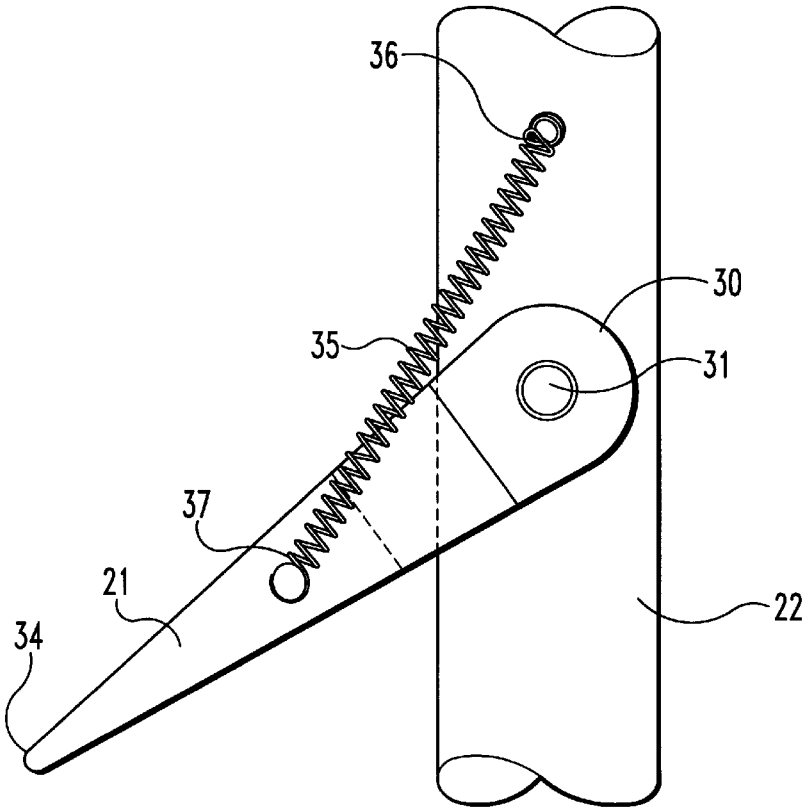
FIG. 2 is an enlarged fragmentary side view of a portion of the handle showing the release means.

In order to prevent the accidental disengagement of the handle from the sheet, end 18 is enlarged. Further, a spring biased latch 21 has a proximal end 30 (FIG. 2) pivotally mounted to the first portion 22 by means of a pin 31. Member 21 includes a pair of ears 32 and 33 (FIG. 3) which extend on the opposite sides of portion 22 with pin 31 then extending through both ears allowing the latch to pivot upward until the distal end 34 contacts first portion 24. A helical spring 35 has a first end 36 extending through and attached to first portion 22 and a second end 37 attached to latch 21 between the opposite ends thereof. Spring 35 is operable to pivot latch 21 in a clockwise direction as viewed in FIG. 2 about pin 31 until end 34 contacts third portion 24. Likewise, the spring is yieldable to allow the latch to pivot in a counterclockwise direction as viewed in FIG. 2 about pin 31 thereby moving distal end 34 apart from third portion 24 and enabling end 19 to be extended through hole 14 and the sheet moved past end 34 when the handle is mounted to the sheet. In order to remove the handle from the sheet, latch 21 is pivoted in a counterclockwise direction with the sheet then being moved past distal end 34 until the sheet clears end 19.

Two versions of the handle shown in FIG. 1 are contemplated by the present invention. One version includes latch 21 whereas the second version does not include the latch. In the event latch 21 is utilized then it is not necessary to provide an enlarged end 18 since the proximal end 30 of the latch limits disengagement of the sheet from first portion 22 when the sheet contacts proximal end 30. Thus, the proximal end 30 and distal end 34 of the latch limit movement between the handle and sheet when the handle is mounted to the sheet. If the latch 21, which provides a release means, is not provided then end 18 should be sized larger than hole 14 to limit disengagement of the sheet from the handle. In all other manners, the versions are identical.

In lieu of grasping the handle with by hand, it is possible to extend the spherical shaped end of a trailer hitch, typically found on a lawn tractor, through the space between location 20 and end 18 thereby enabling the handle and sheet to be towed across the yard.

Figure 4:
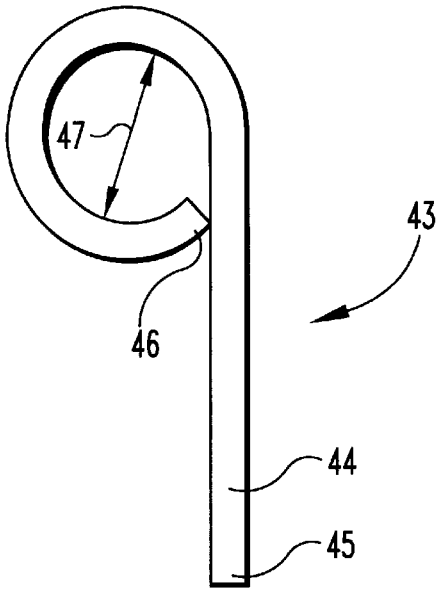
FIG. 4 is a view of an alternate handle.

An alternate design of the handle is shown in FIG. 4. Handle 43 is not provided with the spring biased latch 21 and instead has a flexible spring main body. The spring main body may be produced from any type of spring material, such as, for example, spring steel. Handle 43 has a rod shaped main body 44 with a first end 45 and an opposite end 46. The shank of main body extends in a straight line from end 45 and then curves in a generally circular configuration 47 to end 46. Initially, end 45 may be extended through hole 14 of the sheet and into the ground preventing the sheet from moving relative to the ground as a result of wind or other factors. Once the leaves or other objects are piled atop the sheet, end 45 is pulled from the ground and the sheet is moved along the length of the shank of the handle past end 46 until the sheet material forming and surrounding hole 14 is positioned within the circular configuration. End 46 is movable apart from the shank to allow the sheet to pass therebetween as the sheet at the corner is moved along the shank from end 45 to within the circular configuration 47.

Figure 5:
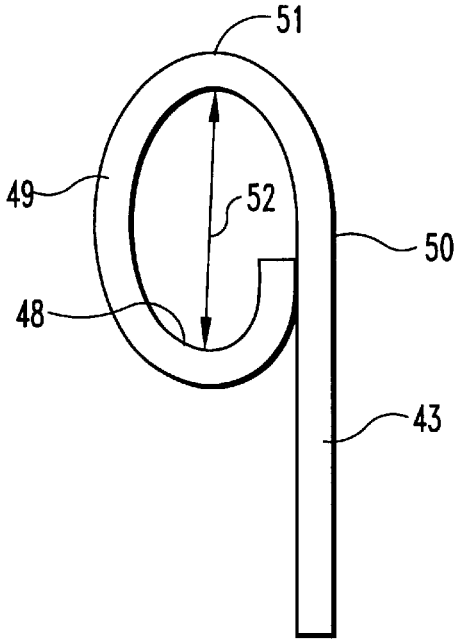
FIG. 5 is the same view as FIG. 4 only showing the handle elastically deformed.

Main body 44 is sufficiently flexible enabling the user to grasp circular configuration 47 and force opposite portions 49 and 50 toward each other elastically deforming the circular configuration 47 into a generally closed configuration formed as an elliptical or oblong configuration 52(FIG. 5) thereby forming a bottom portion 48 and top portion 51 of the ellipse or oblong configuration. The portion of the sheet corner surrounding and forming hole 14 is then contacted against the inwardly facing surface of bottom portion 48 allowing the user to grasp portion 51 and lift or pull the sheet. Similarly, end 45 of handle 43 is extended through holes 13, 41 and 42 so that all corners of the sheet are attached to the same handle 43 forming a bag or container 53, shown in FIG. 6, and allowing the sheet to be lifted and/or pulled to transport the objects contained in the bag. Main body 44 may be produced from spring steel.

In the event the sheet is large or rectangular in configuration, then additional holes may be placed along the length and width thereof. Thus, it is possible to position holes at locations between the corners to extend the handle therethrough. For example, if the sheet is longer than wide, then four holes may be positioned respectively at each corner and an additional hole positioned along each lengthwise extending side between the corners with the handle then extended through all of the holes.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A device for hauling objects across the ground comprising:

a sheet having a first hole at one end thereof and upon which objects may be placed; and, a handle including a rod shaped main body, said handle separable from said sheet but extendable through said first hole and releasably engageable with said sheet allowing said handle to be grasped and pulled to move said sheet across the ground thereby conveying the objects thereon, and wherein:

said rod shaped main body has a sheet holding portion elastically deformable from a generally circular configuration prior to elastic deformation to a generally elliptical configuration after elastic deformation.

2. A device for hauling leaves across the ground comprising:

a sheet upon which leaves may be placed and having corners with holes located at each corner; and, a handle separable from said sheet but extendable through said holes and releasably engageable with said sheet, said handle including a rod shaped main body with a generally straight shank extendable through one of said corners and into the ground to hold said sheet to the ground, said main body includes a top end formed into a closed configuration for grasping to lift and pull said sheet when said shank is removed from the ground and extended through said holes at said corners positioning said corners in said closed configuration, and said top end having a normally generally circular configuration with said shank extendable through each of said corners when removed from the ground and said sheet moved along said shank positioning said corners within said circular configuration, said top end being elastically deformable forming an oblong configuration having a bottom end at which said corners are located and a top end for grasping.

3. The device of claim 2 wherein:

said top end contacts said shank but is releasably movable therefrom to allow said sheet to move between said top end and said shank as said sheet at said corners is moved along said shank and into said circular configuration.

4. The device of claim 3 wherein:

said rod shaped main body is produced from spring steel.

5. A sheet hook comprising:

a rod shaped main body including a first end and a second end, said main body has a first portion which extends in a first direction from said first end and a second portion which extends from said first portion at a first location back in a second direction opposite of said first direction and a third portion which extends from said second portion at a second location back in said first direction to said second end, said second portion positioned between and joined to said first portion and said third portion but separated apart therefrom except where joined, said first portion positioned between said second portion and said third portion, said main body further includes a sheet stop surface at said first location, said main body further includes a grasping portion at said second location spaced apart from said first end allowing said grasping portion to be grasped at said second location and pulled when said main body is extended through a sheet and contacted at said first location on said stop surface.

6. The sheet hook of claim 5 and further comprising:

a spring biased latch with a proximal end pivotally mounted to said first portion and a distal contactable against but movable from said third portion, said proximal end and said distal end limiting movement of said main body and said sheet when said second portion is extended through said sheet.

7. The sheet hook of claim 6 wherein:

said grasping portion includes multiple spaced apart ridges to receive fingers therebetween when said grasping portion is grasped.

8. A device for extending through a hole in a sheet for pulling or lifting the sheet and any items located thereatop comprising:

a rod shaped main body including a first end and a second end, said main body further including a first portion, a second portion and a third portion joined together, said first portion extends from said first end to said second portion which extends from said first portion at a first location back to said third portion which extends from said second portion at a second location back to said second end, said second portion extending between and joined to said first portion and said third portion but separated apart therefrom except where joined at said first location and said second location, said first portion positioned between said second portion and said third portion, said main body further includes a sheet stop surface at said first location, said main body further including a grasping portion at said second location spaced apart from said first end allowing said grasping portion to be grasped at said second location and pulled when said main body is extended through a hole in a sheet and contacted at said first location on said stop surface.

9. The device of claim 8 wherein:

said second portion extends from said first location to said second location in a first direction whereas said third portion extends from said second location to said second end in a second direction with said first direction opposite of said second direction.

* * * * *